US012690655B2

(12) United States Patent
Li et al.

(10) Patent No.: US 12,690,655 B2
(45) Date of Patent: Jul. 28, 2026

(54) ELECTRIC HAIR DRYER

(71) Applicant: WAHL CLIPPER CORPORATION, Sterling, IL (US)

(72) Inventors: Wuhu Li, Zhejiang (CN); Hao Zhang, Zhejiang (CN); Qing Wang, Zhejiang (CN)

(73) Assignee: WAHL CLIPPER CORPORATION, Sterling, IL (US)

( * ) Notice: Subject to any disclaimer, the term of this patent is extended or adjusted under 35 U.S.C. 154(b) by 820 days.

(21) Appl. No.: 18/002,820

(22) PCT Filed: Jun. 28, 2021

(86) PCT No.: PCT/CN2021/102630
§ 371 (c)(1),
(2) Date: Dec. 21, 2022

(87) PCT Pub. No.: WO2022/001920
PCT Pub. Date: Jan. 6, 2022

(65) Prior Publication Data

US 2023/0240423 A1 Aug. 3, 2023

(30) Foreign Application Priority Data

Jul. 3, 2020 (CN) ..... 202010631416.9
Jul. 3, 2020 (CN) ..... 202010632072.3
(Continued)

(51) Int. Cl.
*A45D 20/12* (2006.01)

(52) U.S. Cl.
CPC ..... *A45D 20/12* (2013.01)

(58) Field of Classification Search
CPC ..... A45D 20/12
(Continued)

(56) References Cited

U.S. PATENT DOCUMENTS 1,259,170 A * 3/1918 Trautman ..... A45D 20/12 392/379
2,678,376 A * 5/1954 Lockwood ..... A45D 20/10 248/176.1
(Continued)

FOREIGN PATENT DOCUMENTS

AU 2021299816 A1 * 2/2023 ..... A45D 20/122
CN 204363223 U 6/2015
(Continued)

OTHER PUBLICATIONS

International Search Report and Written Opinion received for PCT/CN2021/102630, mailed Sep. 28, 2021.
(Continued)

*Primary Examiner* — Stephen M Gravini
(74) *Attorney, Agent, or Firm* — Greer, Burns & Crain, Ltd

(57) ABSTRACT

A hair dryer includes a handle, an airduct, a nozzle and a power cord, an included angle is formed between the handle and the airduct; the handle includes a first side surface, a second side surface, a third side surface and a fourth side surface are connected sequentially, the first side surface and the third side surface are arranged oppositely, the second side surface and the fourth side surface are arranged oppositely, and the first side surface is located on an inner side of the included angle of the handle and the airduct; a handle cold and heat switching button is on the first side surface, a power switch, an air speed button and a heat button are on the second side surface, and a composite button is on the third side surface; first air inlets and second air inlets are in two side surfaces of the airduct.

10 Claims, 6 Drawing Sheets

(30) Foreign Application Priority Data

Jul. 3, 2020 (CN) ..... 202021276997.0
Jul. 3, 2020 (CN) ..... 202021276998.5
Jul. 3, 2020 (CN) ..... 202021277957.8

(58) Field of Classification Search
USPC ..... 34/95–100
See application file for complete search history.

(56) References Cited

U.S. PATENT DOCUMENTS

| | | | | |
|---|---|---|---|---|
| 6,148,537 | A | 11/2000 | Altamore | |
| 6,766,590 | B2 | 7/2004 | Altamore et al. | |
| 6,775,922 | B2 | 8/2004 | Langley et al. | |
| 6,957,500 | B2 | 10/2005 | McCambridge et al. | |
| 7,065,899 | B2 * | 6/2006 | Lin | F24H 3/0488 34/97 |
| 7,178,261 | B2 | 2/2007 | McCambridge et al. | |
| 8,302,613 | B2 | 11/2012 | Yde et al. | |
| 8,407,913 | B2 | 4/2013 | Langley et al. | |
| 8,434,238 | B2 * | 5/2013 | Gross | A45D 20/12 132/212 |
| 8,890,035 | B2 * | 11/2014 | Scheunert | A45D 20/12 219/222 |
| 9,808,065 | B2 * | 11/2017 | Moloney | A45D 20/50 |
| 10,575,617 | B2 * | 3/2020 | Courtney | A45D 20/00 |
| 11,647,822 | B2 * | 5/2023 | Kim | A45D 20/122 34/97 |
| 11,751,658 | B2 * | 9/2023 | Fang | A45D 20/122 34/283 |
| 12,402,704 | B2 * | 9/2025 | Wang | H05B 3/0033 |
| 12,440,013 | B2 * | 10/2025 | Park | A45D 20/12 |
| 12,458,124 | B2 * | 11/2025 | Park | F21V 33/0044 |
| 2023/0240423 | A1 * | 8/2023 | Li | A45D 20/122 34/98 |

FOREIGN PATENT DOCUMENTS

| | | | | |
|---|---|---|---|---|
| CN | 104968235 | A | 10/2015 | |
| CN | 204708221 | U | 10/2015 | |
| CN | 205547802 | U | 9/2016 | |
| CN | 205848996 | U | 1/2017 | |
| CN | 207881209 | U | 9/2018 | |
| CN | 208354866 | U | 1/2019 | |
| CN | 109480440 | A | 3/2019 | |
| CN | 209732900 | U | 12/2019 | |
| CN | 111772317 | A | 10/2020 | |
| GB | 2515810 | A * | 1/2015 | A45D 20/52 |
| JP | S55 53005 | U | 4/1980 | |
| KR | 20160067005 | A | 6/2016 | |
| WO | WO-2022001920 | A1 * | 1/2022 | A45D 20/10 |

OTHER PUBLICATIONS

Extended European Search Report received for Application No. 21831972.1, dated Jul. 17, 2024.

* cited by examiner

A(4.000)

ELECTRIC HAIR DRYER

BACKGROUND

The invention relates to the technical field of an electrical equipment, and in particular, to an electric hair dryer.

The hair dryer directly relies on electric motor to drive the rotor to rotate. When the blade rotates, the air is sucked in from the air inlet, and the centrifugal air flow is blown out by the front nozzle of the airduct. When the air passes through, if the heating wire on the heating bracket installed in the air nozzle has been electrified and heated, the hot air will be blown out; if the switch is not used to electrify the heating wire, the cold air will be blown out. Hair dryer is to achieve the purpose of drying and shaping.

Traditional hair dryers have following technical defects:

The patent document with the publication number CN205848996U discloses an optimal hair dryer. The heat and the air speed of the traditional hair dryer are adjusted by a toggle switch, and most of heat and air speed adjusting switches are arranged on the inner side of the included angle between the handle and the airduct. During use, the hair dryer is located at the four-finger holding position, and it is necessary to adjust the gear before use. If it is necessary to adjust the gear during use, since it is inconvenient to toggle the gear by the four fingers, the gear switch can be toggled by the other hand to adjust the gear, that is, gear adjustment can be realized by double hands, which is inconvenient to use.

The patent document with the publication number CN104968235A discloses a front nozzle. A conventional nozzle is basically connected to the electric hair dryer by means of clamping the nozzle to the electric hair dryer via a clamping fastener, which is inconvenient to use.

SUMMARY

For the defects in the prior art, an objective of the present invention is to provide a hair dryer.

A hair dryer according to the present invention includes, a handle 102, an airduct 1010, a nozzle 1011 and a power cord 101, wherein one end of the handle 102 is connected to the power cord 101, the other end of the handle 102 is connected to one end of the airduct 1010, the other end of the airduct 1010 is connected to the nozzle 1011, and an included angle is formed between the handle 102 and the airduct 1010;

- the handle 102 comprises a first side surface, a second side surface, a third side surface and the fourth side surface which are connected sequentially, the first side surface and the third side surface are arranged oppositely, the second side surface and the fourth side surface are arranged oppositely, and the first side surface is located on an inner side of the include angle of the handle 102 and the airduct 1010;
- a handle cold and heat switching button 1013 is arranged on the first side surface, a power switch 106, an air speed button 103 and a heat button 104 are arranged on the second side surface, and a composite button 105 is arranged on the third side surface;
- first air inlets 108 and second air inlets 1012 are formed in two side surfaces of one end of the airduct 1010, and a heating device and a fan device are arranged in one end of the airduct 1010; function display screens 107 are arranged on two side surfaces or one side surface of one end of the airduct 1010; and an airduct cold and heat switching button 109 is arranged on a top surface of the airduct 1010.

Preferably, a circuit board is arranged in the handle 102, a controller is arranged on the circuit board, the circuit board is respectively connected to the heating device, the fan device, the power cord 101, the power switch 106, the air speed button 103, the heat button 104, the composite button 105, the airduct cold and heat switching button 109, the handle cold and heat switching button 1013 and the function display screen 107.

Preferably, the nozzle 1011 comprises a magnetic nozzle or a fluffing and styling nozzle.

Preferably, the magnetic nozzle comprising a nozzle head 201, a nozzle ring 202, a connector 203, a tightening member 204, wherein,

- the connector 203 comprises a first connector and a second connector;
- the nozzle ring 202 is tightly connected to the nozzle head 201 via the first connector;
- the tightening member 204 is connected to the airduct 1010 via the second connector;
- the tightening member 204 is connected to the airduct 1010; and
- the tightening member 204 adopts a magnetic steel hoop.

Preferably, the first connector adopts a first self-tapping screw, and the nozzle ring 202 is tightly connected to the nozzle head 201 via four first self-tapping screws; wherein,

- the second connector adopts a second self-tapping screw; and
- the tightening member 204 is connected to the airduct 1010 via the second self-tapping screw.

Preferably, the nozzle head 201 comprises a nozzle head boss structure;

- the first self-tapping screw comprises a first self-tapping screw pan head; and
- the nozzle ring 202 is disposed between the first self-tapping screw pan head and the nozzle head boss structure.

Preferably, the fluffing and styling nozzle comprising a diffusing shell 404, a mesh cylinder 405, a flow dividing platform 407, a baffle plate 408, a magnetic part supporting rib reverse side 409, a middle air outlet hole 4010 and an internal diffusing chamber 4011;

- the flow dividing platform 407 and the baffle plate 408 are arranged on the diffusing shell 404, the baffle plate 408 is arranged at the bottom of the flow dividing platform 407, and the baffle plate 408 and the magnetic part supporting rib reverse side 409 form a side surface gap flow channel; and
- gas flowing out of the fluffing and styling nozzle is from the middle air outlet hole 4010 and the side surface gap flow channel, gas flowing out of the middle air outlet hole 4010 enters the internal diffusing chamber 4011, gas flowing out of the side surface gap flow channel is guided by the baffle plate 408 to side surfaces and edges of the mesh cylinder 405, and gases flowing out of the two portions flow out uniformly through mesh openings of the mesh cylinder 405.

Preferably, the fluffing and styling nozzle further comprises a first fixing device 401, a locking device 402 and a magnetic part 403, wherein the magnetic part 403 is fixed by the first fixing device 401 on the diffusing shell 404 through the locking device 402.

Preferably, a chamber formed between inner walls of the flow dividing platform 407 on the diffusing shell 404 is an internal diffusing chamber 4011.

Preferably, a temperature sensor 315 and a ceramic protective net 316 are arranged in the other end of the airduct 1010.

Compared with the prior art, the present invention has the following beneficial effects:

1. the button position setting of the invention fully considers ergonomics and usage experience, so that the hair dryer is more convenient for users to operate, and switching of air gear, heat and the like can be realized with one hand. Users can switch air gear, heat and the like only by pressing during use. The power switch, the air speed button and the heat button are arranged on the second side surface of the handle, the composite button is arranged on the third side surface of the handle, and the second side surface and the third side surface of the handle are located at a position which can be operated by a thumb during holding, that is, air speed, heat and the like may be switched by the thumb of the holding hand before or during use. The handle cold and heat switching button is arranged on the first side surface of the handle, the first side surface of the handle is located at the four-finger holding position when being held, and cold and hot air gears can be switched by pressing through four fingers. The airduct cold and heat switching button is arranged at the top of the airduct. If the hairstylist wants to hold the airduct with the hand to perform modeling and shaping operation during hairdressing, cold and heat switching can be performed by pressing the airduct cold and heat switching button with the thumb and it is unnecessary to press the cold and heat switching button on the handle with the other hand.
2. The magnetic nozzle adopts the principle of using a magnetic steel hoop to attract the steel nozzle ring, solves the problem of stiff connection between a nozzle and an electric hair dryer body, and solves the problem of inconvenient plug and rotation of the nozzle.
3. By adoption of the structures of the flow dividing platform and the baffle plate on the diffusing shell, the problems about gas flow division and gas energy reduction and pressure reduction are solved. By adoption of the structure of the inner wall, namely the internal diffusing chamber, of the flow dividing platform on the diffusing shell, the problem that gas flowing out of the center has too high air speed is solved. By adoption of the structures of small holes on the mesh cylinder in the axial direction and the radial direction and the structure of the air outlet claw net, the problem of uniform gas distribution is solved. The elbows and a sieve are provided for reducing fluid flow; meanwhile, a main diffusing chamber and the internal diffusing chamber are provided for increasing the section area of the air outlet flow channel, and part of dynamic pressure of the air is converted into the static pressure, thereby entirely reducing the flow speed of the gas. The middle air outlet and the surrounding air outlet gaps are provided for dividing the gas, and the flow of the gas in each flow direction is controlled by adjusting the sizes of the middle air outlet hole and the surrounding air outlet gaps, so that air is output entirely and uniformly.

BRIEF DESCRIPTION OF DRAWINGS

The other features, objectives and advantages of the present invention will become more apparent by reading the detailed descriptions made for non-restrictive embodiments with reference to the following accompanying drawings.

DETAILED DESCRIPTION

The present invention is described in detail below with reference to the specific embodiments. The following embodiments will help those skilled in the art to further understand the present invention, but do not limit the present invention in any way. It should be pointed out that several changes and improvements may be made by those of ordinary skill in the art without departing from the conception of the present invention. These changes and improvements all belong to the protection scope of the present invention.

Figure 1:
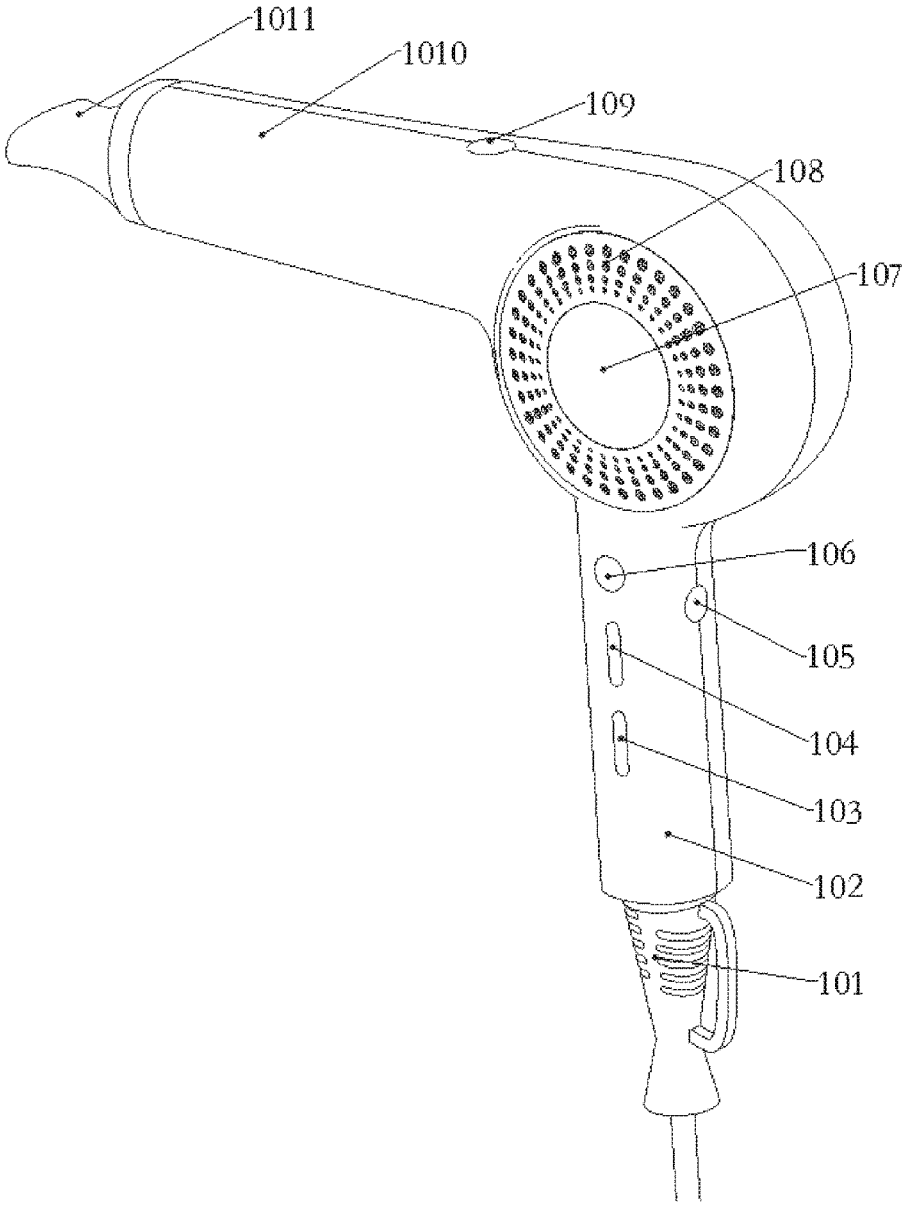
FIG. 1 is a structural schematic diagram of an angle according to the present invention.
Figure 2:
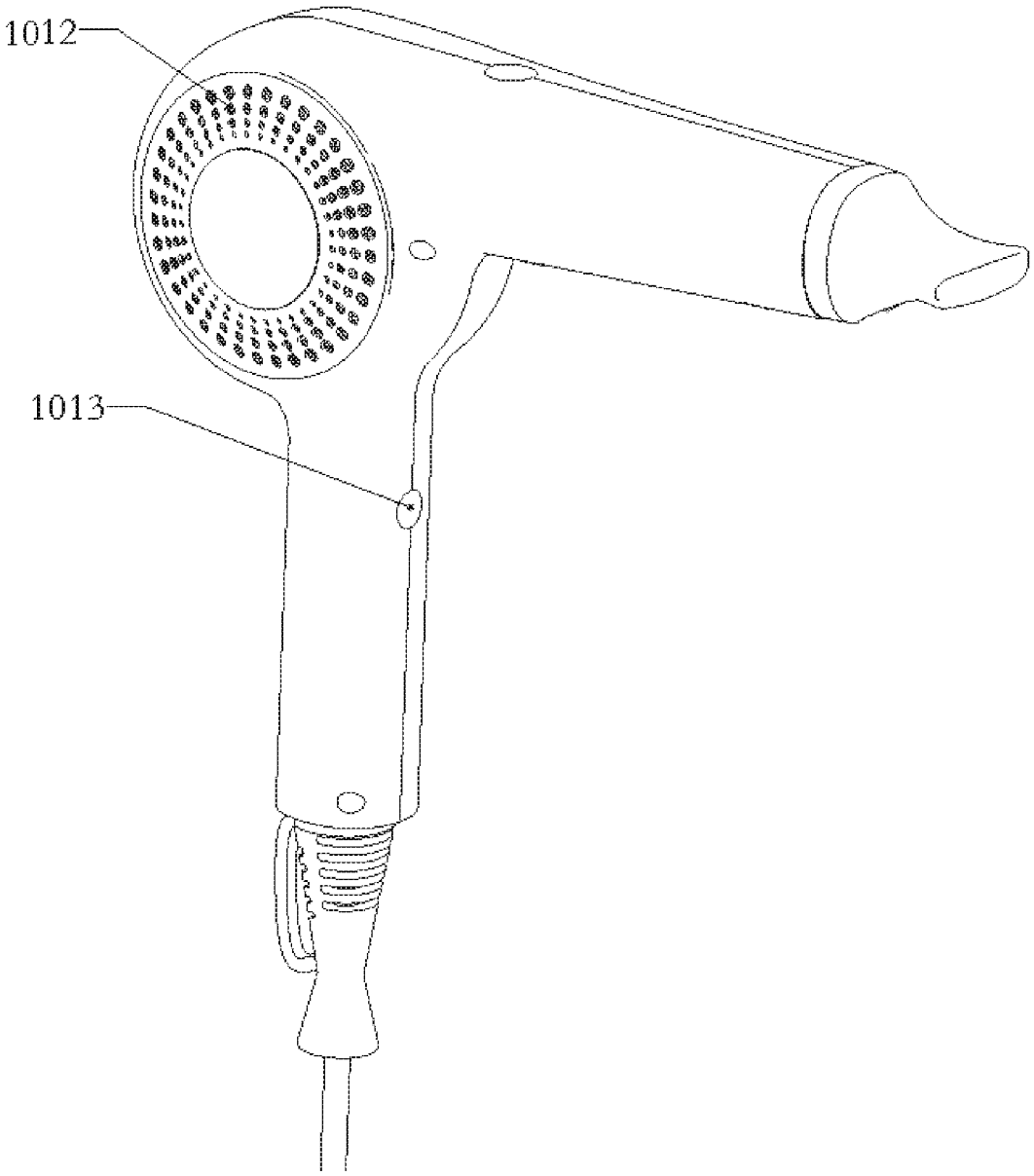
FIG. 2 is a structural schematic diagram of another angle according to the present invention.

According to the invention, a hair dryer, as shown in FIG. 1 to FIG. 2, includes a handle 102, an airduct 1010, a nozzle 1011 and a power cord 101, wherein one end of the handle 102 is connected to the power cord 101, the other end of the handle 102 is connected to one end of the airduct 1010, the other end of the airduct 1010 is connected to the nozzle 1011, and an included angle is formed between the handle 102 and the airduct 1010; the handle 102 includes a first side surface, a second side surface, a third side surface and a fourth side surface which are connected sequentially, the first side surface and the second side surface are arranged oppositely, the second side surface and the fourth side surface are arranged oppositely, and the first side surface is located on an inner side of the included angle of the handle 102 and the airduct 1010; a handle cold and heat switching button 1013 is arranged on the first side surface, a power switch 106, an air speed button 103 and a heat button 104 are arranged on the second side surface, and a composite button 105 is arranged on the third side surface; first air inlets 108 and second air inlets 1012 are formed in two side surfaces of one end of the airduct 1010, and a heating device and a fan device are arranged in one end of the airduct 1010; function display screens 107 are arranged on two side surfaces or one side surface of one end of the airduct 1010; and an airduct cold and heat switching button 109 is arranged on a top surface of the airduct 1010. The power switch 106 is a pressing button. The second side surface and the third side surface are located at a position which can be operated by a thumb during holding, and the first side surface is located at a position which can be operated by four fingers (pressing operation) during holding. The invention adopts the pressing button, and the button position setting of the invention fully considers ergonomics and usage experience, so that the hair dryer is more convenient for users to operate, and switching of air gear, heat and the like can be realized with one hand.

A circuit board is arranged in the handle 102, a controller is arranged on the circuit board, and the circuit board is respectively connected to the heating device, the fan device, the power cord 101, the power switch 106, the air speed button 103, the heat button 104, the composite button 105, the airduct cold and heat switching button 109, the handle cold and heat switching button 1013 and the function display screen 107. The airduct cold and heat switching button 109 and the handle cold and heat switching button 1013 are connected to the circuit board in parallel. A temperature sensor is arranged on the heating device and is connected to the circuit board. An anemometer is arranged on the fan device and is connected to the circuit board. In the invention, connection control modes of all the buttons, the function display screen, the fan device, the heating device and the circuit board are all in the prior art, and air speed gears and heat gears are switched by the buttons. The function display screen 107 adopts a function display color screen and can display air speed and temperature in real time.

The composite button 105 is connected to a chip, and the chip is connected to the circuit board; and temperatures and air speeds under three modes of quick drying, modeling and shaping are recorded on the chip. The composite button 105 can switch the three modes of quick drying, modeling and shaping, each model switching including switching of air speed and heat, which can be realized by a plurality of keys in the traditional design. Air speed and heat under three modes of quick drying, modeling and shaping are recorded on the chip, including optimum temperature and air speed numerical parameters which are achieved through market research and site test used under three modes. During use, the hairstylist can sequentially realize the quick drying, modeling and shaping functions only by lightly touching the composite button 105. In the default state, that is, when the hairstylist turns on the hair dryer, the composite button 105 is in the quick drying mode; when the hairstylist presses the composite button 105, the hair dryer is in the modeling mode; and when the hairstylist presses the composite button 105 again, the hair dryer is in the shaping mode. When the composite button is pressed again, the hair dryer defaults the quick drying function. In this way, the operation time of the hairstylist, the number of the buttons and the space size at the handle of the hair dryer are saved. Optimal combination of various kinds of heat and air speed is realized by the composite button 105. It is especially helpful for the junior hairstylist. The hairstylists who have just entered the hair style design and hairdressing industries do not need to explore the temperature and air speed required by various models through long-time exploration.

Both the air speed button 103 and the heat button 104 are straight line-shaped. Two ends of the straight line shape can realize addition and subtraction of the air speed or heat through the circuit board, the air speed or heat is increased when the hairstylist presses the top of the straight-line-shaped button, and the air speed or heat is reduced when the hairstylist presses the bottom of the straight-line-shaped button; therefore, operation of the hairstylist is facilitated and the space of the handle of the hair dryer is saved.

For the cold and heat switching key, there is only one key on the handle in the traditional design, so that the hairstylist must operate the cold and heat switching key on the handle with the other hand to realize cold and heat switching if needing to perform cold and heat switching when holding the airduct to perform modeling and shaping operation during hairdressing. According to the invention, the cold and heat switching buttons are arranged on the handle and the airduct and the two buttons are connected in parallel, so that the hairstylist may press the airduct cold and heat switching button 109 with the holding hand to realize cold and heat switching when holding the airduct for hairdressing, and the hairstylist may also press the handle cold and heat switching button 1013 with the holding hand to realize cold and heat switching when performing operation by holding the handle with the hand. Through the double cold and heat switching switches, the problem that the hairstylist has to operate the cold and heat switches with double hands during hairdressing is solved conveniently.

The nozzle 1011 includes magnetic nozzle and fluffing and styling nozzle.

Figure 3:
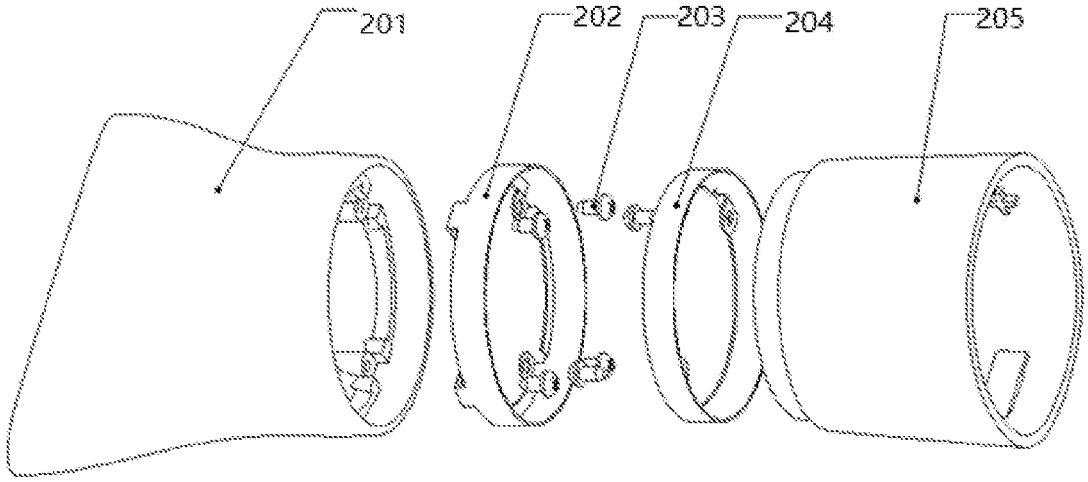
FIG. 3 is an exploded view of the magnetic nozzle.
Figure 4:
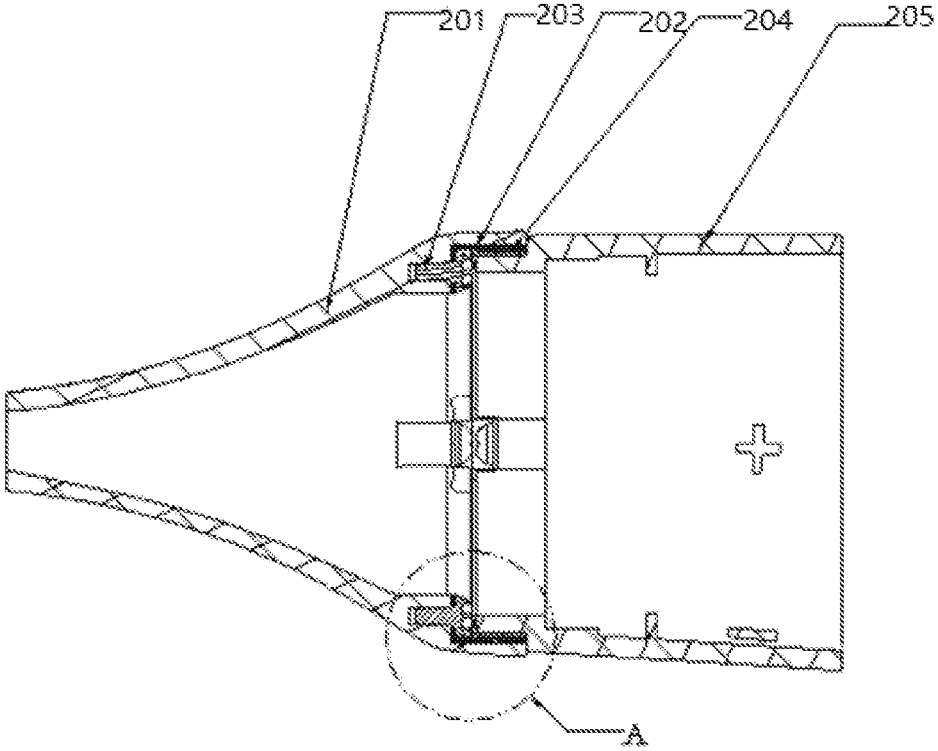
FIG. 4 is a schematic view of the overall structure of the magnetic nozzle.
Figure 5:
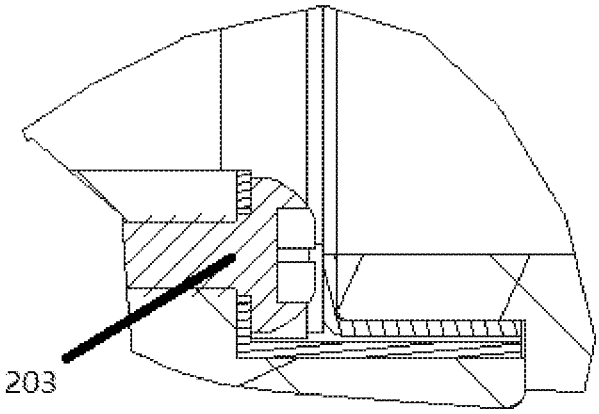
FIG. 5 is a structural schematic view of the self-tapping screw of the magnetic nozzle.

As shown in FIG. 3-5, the invention provides a magnetic nozzle apparatus for an electric hair dryer, including a nozzle head 201, a nozzle ring 202, a connector 203, and a tightening member 204, wherein the connector 203 includes a first connector and a second connector; the nozzle ring 202 is tightly connected to the nozzle head 201 via the first connector; the tightening member 204 is connected to the airduct 1010 via the second connector; the tightening member 204 is connected to airduct 1010; and the tightening member 204 adopts a magnetic steel hoop. The steel nozzle ring is made from a ferromagnetic material; the magnetic steel hoop is made from a magnetic material; the steel nozzle ring is rigidly connected to the nozzle; the magnetic steel hoop is rigidly connected to the air duct (a part); the steel nozzle ring is attracted by the magnetic steel hoop under a magnetic attraction force, so as to tightly connect the air duct (a part) to the nozzle. Specifically, in one embodiment, the nozzle head 201 has two types: an opening nozzle head, a pointed nozzle head, and nozzle heads in other shapes.

The first connector adopts a first self-tapping screw; and the nozzle ring 202 is tightly connected to the nozzle head 201 via the first self-tapping screw. The nozzle ring 202 is tightly connected to the nozzle head 201 via four first self-tapping screws. The second connector adopts a second self-tapping screw; and the tightening member 204 is connected to the airduct 1010 via the second self-tapping screw. The tightening member 204 is connected to the airduct 1010 via two second self-tapping screws. The nozzle head 201 includes a nozzle head screw hole; the number of the nozzle head screw holes is four; the four nozzle head screw holes are matched with the four first self-tapping screws; and the steel nozzle ring 2 is tightly clamped and locked by a pan head of the self-tapping screw 3 and a boss structure of a nozzle. The nozzle head 201 includes a nozzle head boss structure; the first self-tapping screw includes a first self-tapping screw pan head; and the nozzle ring 202 is disposed between the first self-tapping screw pan head and the nozzle head boss structure. The airduct 1010 includes an air duct component screw hole; the number of the air duct component screw holes is two; and the two air duct component screw holes are matched with the two second self-tapping screws.

The tightening member 204 further includes a tightening member through hole; the second self-tapping screw penetrates though the tightening member through hole. The airduct 1010 includes an air duct component boss structure; the second self-tapping screw includes a second self-tapping screw pan head; and the tightening member 204 is disposed between the second self-tapping screw pan head and the air duct component boss structure. The tightening member 204 is tightly clamped and locked by the self-tapping screw pan head and the air duct component boss structure.

Preferably, the nozzle ring 202 is made from steel; and the tightening member 204 adopts a magnetic steel hoop.

Specifically, in one embodiment, the steel nozzle ring is fixed on the nozzle via four self-tapping screws; and the magnetic steel hoop is fixed on the air duct (a part) via two self-tapping screws, wherein the nozzle is provided thereon with four screw holes to match with the self-tapping screws for fixation; the steel nozzle ring is provided thereon with four through holes for the self-tapping screws to penetrate through; and the steel nozzle ring is tightly clamped and locked by the self-tapping screw pan head and the nozzle boss structure. Similarly, the air duct (a part) is provided thereon with two screw holes to match with the self-tapping screws for fixation; the magnetic steel hoop is provided thereon with two through holes for the self-tapping screws to penetrate through; and the magnetic steel hoop is tightly clamped and locked by the self-tapping screw pan head and the boss structure of the air duct (a part).

The invention adopts the principle of using a magnetic steel hoop to attract the steel nozzle ring, solves the problem of stiff connection between a nozzle and an electric hair dryer body, and solves the problem of inconvenient plug and rotation of the nozzle. The invention has a reasonable structure, is simple to use, and overcomes the defects in the prior art.

Figure 6:
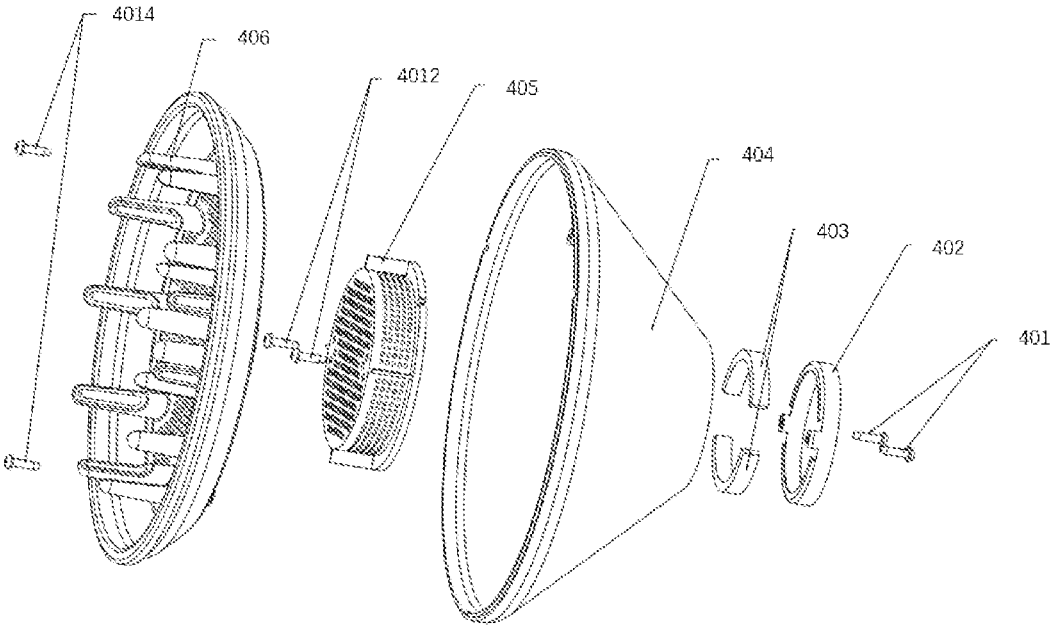
FIG. 6 is a first schematic diagram of a fluffing and styling nozzle.
Figure 7:
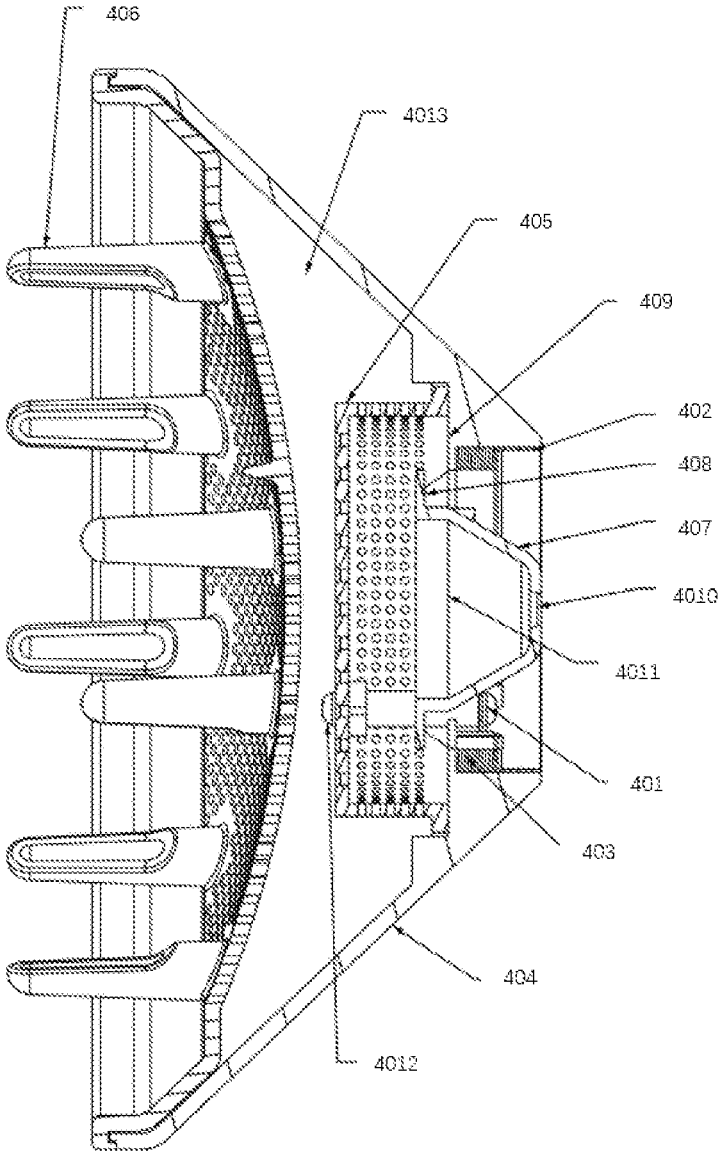
FIG. 7 is a second schematic diagram of a fluffing and styling nozzle.

As shown in FIG. 6 and FIG. 7, the fluffing and styling nozzle, includes: a first fixing device 401, a locking device 402, a magnetic part 403, a diffusing shell 404, a mesh cylinder 405, an air outlet claw net 406, a flow dividing platform 407, a baffle plate 408, a magnetic part supporting rib reverse side 409, a middle air outlet hole 4010, an internal diffusing chamber 4011, a second fixing device 4012, a main diffusing chamber 4013 and a third fixing device 4014, wherein the magnetic part 403 is fixed by the first fixing device 401 on the diffusing shell 404 through the locking device 402, the mesh cylinder 405 is fixed on the diffusing shell 404 through by the second fixing device 4012, and the air outlet claw net 406 is fixed on the diffusing shell 404 by the third fixing device 4014.

The flow dividing platform 407 and the baffle plate 408 are arranged on the diffusing shell 404, the baffle plate 408 is arranged at the bottom of the flow dividing platform 407, and the baffle plate 408 and the magnetic part supporting rib reverse side 409 form a side surface gap flow channel; and gas flowing out of the fluffing and styling nozzle is from the middle air outlet hole 4010 and the side surface gap flow channel, gas flowing out of the middle air outlet hole 4010 enters the internal diffusing chamber 4011, gas flowing out of the side surface gap flow channel is guided by the baffle plate to side surfaces and edges of the mesh cylinder 405, and gases flowing out of the two portions flow out uniformly through mesh openings of the mesh cylinder 405.

The air outlet claw net 406 and the mesh cylinder 405 are provided with a plurality of mesh openings in axial directions and radial directions, and the mesh openings of the outlet claw net 406 correspond to the mesh openings of the mesh cylinder 405 in an overlapping portion; and a chamber formed between inner walls of the flow dividing platform 407 on the diffusing shell 404 is an internal diffusing chamber 4011. A cross section of the diffusing shell 404 is round and a side section view is trapezoidal. The elbows and a sieve are provided for reducing fluid flow; meanwhile, a main diffusing chamber 4013 and the internal diffusing chamber are provided for increasing the section area of the air outlet flow channel, and part of dynamic pressure of the air is converted into the static pressure, thereby entirely reducing the flow speed of the gas. The middle air outlet 4010 and surrounding air outlet gaps are provided for dividing gas, and the flow of the gas in each flow direction is controlled by adjusting the sizes of the middle air outlet hole 4010 and the surrounding air outlet gaps, so that air is output entirely and uniformly.

The first fixing device 401, the second fixing device 4012 and the third fixing device 4014 may adopt self-tapping screws without punching bottom holes and drilling wires.

The diffusing shell may adopt an ABS material or a PC material; and the mesh openings may be small round holes and may also be small square holes.

A frustum cap type flow dividing platform (hereinafter referred to as flow dividing platform 407) is arranged an inlet of the diffusing shell 404, the middle is punched, and the baffle plate 408 is arranged at the root of the flow dividing platform and forms a side surface gap flow channel with the magnet supporting rib reverse side 409. The gas is pressed into the fluffing and styling nozzle from an air duct of the hair dryer, enters the inlet of the diffusing shell 404 firstly, is divided on the flow dividing platform 407 to form many strands of gas flow, and the gas flow flows out of the middle air outlet hole 4010 and four sides of the flow dividing platform respectively. The flow dividing platform 407 blocks the front side of the gas except for the middle air outlet hole 4010, the gas has to change the flow direction to flow out from the side surface gap flow channel and from the middle air outlet hole 4010, and the gas energy is lost by the local resistance of the flow dividing platform 407. On the other hand, the baffle plate 408 at the root of the flow dividing platform 407 increases wind resistance and changes the flow direction of the gas, and is similar to an elbow to reduce the gas energy. Then, the gas (hereinafter referred as the middle outflow gas) flowing out of the middle air outlet hole 4010 enters the inner wall, namely the internal diffusing chamber, of the frustum cap type flow dividing platform. Due to the increase of the section area of the flow channel, the middle outflow gas diffuses and the flow speed is reduced. Gas (hereinafter referred as side outflow gas) flowing out of the four side surface gap flow channels enters into the mesh cylinder, the root of the mesh cylinder 405 is attached to the diffusing shell 404, and the side overflow gas only can flow out through the mesh openings in the front side and the side surfaces of the mesh cylinder 405. On one hand, the gas energy is reduced by the fine mesh openings of the mesh cylinder 405; and on the other hand, the flow becomes thinner, so that the outflow gas is more uniform. The middle outflow gas flows out of the internal diffusing chamber 4011 and enters into the mesh cylinder 405. Due to the mutual influence of the side overflow gas and the middle outflow gas, the gas passes through the fine mesh openings of the mesh cylinder 405 uniformly, similarly, the gas energy is further reduced. The side outflow gas and the middle outflow gas enter the main diffusing chamber 4013 after passing through the mesh cylinder 405. With the interaction between the gases and gradual increase of the inner section area of the main diffusing chamber 4013, the gas is entirely uniform and the speed is reduced. The wind resistance is further increased by the air outlet claw net 406 and the gas flow becomes thinner, so that the gas is output entirely uniformly at low speed.

Figure 8:
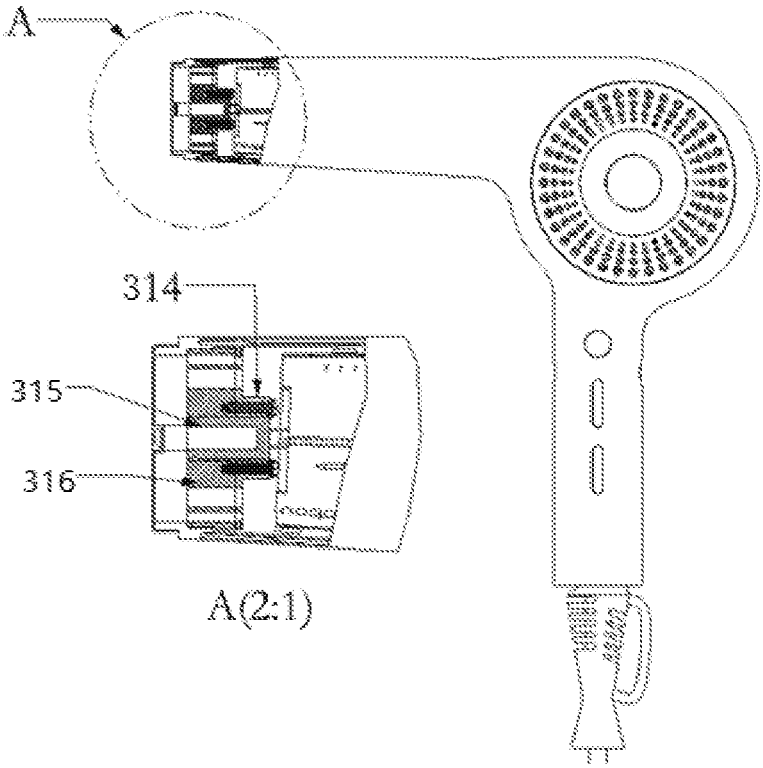
FIG. 8 is a structural schematic view of the outlet of the airduct.

As shown in FIG. 8, the temperature sensor 315 and the ceramic protective net 316 is arranged in the other end of the airduct 1010. The sensor bracket 314 is arranged on the airduct inner wall 1010, and the temperature sensor 315 is arranged on the sensor bracket 314.

The electric hair dryer has high power of a heating wire and has high radiation under alternating current. In addition, the air temperature of the traditional electric hair dryer blowing the hair has a great relationship with the distance between the hair and the air outlet. The temperature is low when the distance is long, and the temperature is high when the distance is short.

The power of the heating wire is adjusted instantaneously through infrared detection on the temperature of hair, so that the temperature of blowing the hair has little to do with a distance. That is, within a certain range, when the hairstylist blows the hair, the temperature of blowing the hair has nothing to do with the moving distance of the hand of the hairstylist, and is only related to an initial temperature set by the hairstylist. At this time, the power of the heating wire is adjusted constantly along with the operation of the hairstylist to achieve constant temperature, but when the electromagnetic radiation of the hearting wire is emitted through outlet, the ceramic protective net 316 will block the radiation, thereby realizing the effect of anti-radiation.

In the description of the present application, it should be understood that an azimuth or position relationship indicated by terms "upper", "lower", "front", "rear", "left", "right", "vertical", "horizontal", "top", "bottom", "inner", "outer" and the like is an azimuth or position relationship based on the accompanying drawings, which is only for facilitating description of the present application and simplifying description, but not indicates or implies that the referred device or component must have a specific azimuth and perform construction and operation in the specific azimuth; therefore, it cannot be interpreted as a limitation to the present application.

The specific embodiments of the present invention are described above. It should be understood that the present invention is not limited to the above specific embodiments, and those skilled in the art may make various changes or modifications within the scope of the claims, which does not affect the essential content of the present invention. The embodiments of the present application and the features in the embodiments may be arbitrarily combined with each other without conflict.

What is claimed is:

1. A hair dryer, comprising: a handle, an airduct, a nozzle and a power cord, wherein one end of the handle is connected to the power cord, an opposite end of the handle is connected to a first end of the airduct, a second, opposite end of the airduct is connected to the nozzle, and an included angle is formed between the handle and the airduct;

the handle comprises a first side surface, a second side surface, a third side surface and a fourth side surface which are connected sequentially, the first side surface and the third side surface are arranged oppositely, the second side surface and the fourth side surface are arranged oppositely, and the first side surface is located on an inner side of the included angle of the handle and the airduct;

a handle cold and heat switching button is arranged on the first side surface, a power switch, an air speed button and a heat button are arranged on the second side surface, and a composite button is arranged on the third side surface; and first air inlets and second air inlets are formed in two side surfaces of one of said ends of the airduct, and a heating device and a fan device are arranged in one of said ends of the airduct; function display screens are arranged on two side surfaces or one side surface of one of said ends of the airduct; and an airduct cold and heat switching button is arranged on a top surface of the airduct.

2. The hair dryer according to claim 1, wherein a circuit board is arranged in the handle, a controller is arranged on the circuit board, the circuit board is respectively connected to the heating device, the fan device, the power cord, the power switch, the air speed button, the heat button, the composite button, the airduct cold and heat switching button, the handle cold and heat switching button and the function display screens.

3. The hair dryer according to claim 1, wherein the nozzle comprises a magnetic nozzle or a fluffing and styling nozzle.

4. The hair dryer according to claim 3, wherein the magnetic nozzle comprises a nozzle head, a nozzle ring, a connector, a tightening member, wherein, the connector comprises a first connector and a second connector;

the nozzle ring is tightly connected to the nozzle head via the first connector;

the tightening member is connected to the airduct via the second connector;

the tightening member is connected to the airduct; and the tightening member adopts a magnetic steel hoop.

5. The hair dryer according to claim 4, wherein the first connector adopts a first self-tapping screw and the nozzle ring is tightly connected to the nozzle head via four first self-tapping screws; wherein, the second connector adopts a second self-tapping screw; and the tightening member is connected to the airduct via the second self-tapping screw.

6. The electric hair dryer according to claim 4, wherein the nozzle head comprises a nozzle head boss structure;

the first self-tapping screw comprises a first self-tapping screw pan head; and the nozzle ring is disposed between the first self-tapping screw pan head and the nozzle head boss structure.

7. The hair dryer according to claim 3, wherein the fluffing and styling nozzle comprises a diffusing shell, a mesh cylinder, a flow dividing platform, a baffle plate, a magnetic part supporting rib reverse side, a middle air outlet hole and an internal diffusing chamber;

the flow dividing platform and the baffle plate are arranged on the diffusing shell, the baffle plate is arranged at a bottom of the flow dividing platform, and the baffle plate and the magnetic part supporting rib reverse side form a side surface gap flow channel; and gas flowing out of the fluffing and styling nozzle is from the middle air outlet hole and the side surface gap flow channel, gas flowing out of the middle air outlet hole enters the internal diffusing chamber, gas flowing out of the side surface gap flow channel is guided by the baffle plate to side surfaces and edges of the mesh cylinder, and gases flowing out of the side surface gap flow channel and the middle air outlet hole flow out uniformly through mesh openings of the mesh cylinder.

8. The hair dryer according to claim 7, wherein the fluffing and styling nozzle further comprises a first fixing device, a locking device and a magnetic part, wherein the magnetic part is fixed by the first fixing device on the diffusing shell through the locking device.

9. The hair dryer according to claim 7, wherein a chamber formed between inner walls of the flow dividing platform on the diffusing shell is an internal diffusing chamber.

10. The hair dryer according to claim 1, wherein a temperature sensor and a ceramic protective net are arranged in the second end of the airduct.

* * * * *